US012428212B2

(12) United States Patent
Doran et al.

(10) Patent No.: US 12,428,212 B2
(45) Date of Patent: Sep. 30, 2025

(54) BEVERAGE RECEPTACLE

(71) Applicant: STUBS PTY LTD, Langwarrin (AU)

(72) Inventors: Nathan Doran, Langwarrin (AU); Jayson Prior, Langwarrin (AU)

(73) Assignee: STUBS PTY LTD, Langwarrin (AU)

( * ) Notice: Subject to any disclaimer, the term of this patent is extended or adjusted under 35 U.S.C. 154(b) by 306 days.

(21) Appl. No.: 18/023,597

(22) PCT Filed: Aug. 26, 2021

(86) PCT No.: PCT/AU2021/050983
§ 371 (c)(1),
(2) Date: Feb. 27, 2023

(87) PCT Pub. No.: WO2022/040745
PCT Pub. Date: Mar. 3, 2022

(65) Prior Publication Data

US 2024/0017910 A1 Jan. 18, 2024

(30) Foreign Application Priority Data

Aug. 27, 2020 (AU) ..... 2020903067

(51) Int. Cl.
*B65D 81/38* (2006.01)
*A47G 23/02* (2006.01)

(52) U.S. Cl.
CPC ..... *B65D 81/3881* (2013.01); *A47G 23/0241* (2013.01); *A47G 23/0266* (2013.01); *A47G 2023/0291* (2013.01)

(58) Field of Classification Search
CPC ..... B65D 81/3865; B65D 81/3867; B65D 81/3869; B65D 81/3872; B65D 81/3874; B65D 81/3876; B65D 81/3879; B65D 81/3881; B65D 81/3883; B65D 81/3886; B65D 81/3888; B65D 81/389; B65D 81/3893; B65D 81/3895; B65D 81/3897
See application file for complete search history.

(56) References Cited

U.S. PATENT DOCUMENTS

| | | | | |
|---|---|---|---|---|
| 4,383,422 | A | 5/1983 | Gordon et al. | |
| 6,401,993 | B1 | 6/2002 | Andrino | |
| 2003/0197020 | A1 * | 10/2003 | Murakami | B65D 81/3876 220/739 |

FOREIGN PATENT DOCUMENTS

| | | | | |
|---|---|---|---|---|
| GB | 2486909 | A | 7/2012 | |
| WO | WO-2008078860 | A1 * | 7/2008 | B65D 81/3881 |

OTHER PUBLICATIONS

International Search Report and Written Opinion for International Application No. PCT/AU2021/050983, mailing date of.

* cited by examiner

*Primary Examiner* — Javier A Pagan
(74) *Attorney, Agent, or Firm* — FRESH IP PLC; Clifford D. Hyra; Aubrey Y. Chen

(57) ABSTRACT

A beverage receptacle configured to receive a beverage container, comprising a tubular body having a tubular portion and a base, a cavity within the tubular body adapted to receive the beverage container, a rubber sleeve at least partially surrounding the tubular portion of the tubular body, a bearing means adapted to bear on the beverage container, and wherein the beverage receptacle is formed of an insulating material.

19 Claims, 17 Drawing Sheets

BEVERAGE RECEPTACLE

FIELD OF INVENTION

The present invention relates to a beverage receptacle. More specifically, this application relates to beverage receptacles that are configured to receive hot or cold beverages.

BACKGROUND OF THE INVENTION

Any discussion of the prior art throughout the specification should in no way be considered as an admission that such prior art is widely known or forms part of common general knowledge in the field.

Beverage receptacles are used to keep hot and cold beverages within a desired temperature range for a prolonged period of time by storing the container the beverage resides in, thereby allowing the beverage to be consumed at a later point in time without sacrificing the recommended drinking temperature of the beverage. The beverage receptacles are usually stainless-steel vacuum receptacles which are able to keep the beverage either hot or cold. However, stainless-steel vacuum receptacles are slippery, hot or cold to the touch and not ergonomic to hold.

Another a popular beverage receptacle used to store a beverage container is the stubby holder. Traditionally, stubby holders are formed of neoprene are used to insulate beer, as well as protect a user's fingers from the temperature of the beverage container. Unlike stainless steel beverage receptacles, stubby holders advantageously protect a user's hands from the temperature of the beverage container, however they do a poor job of retaining the beverage's temperature.

Beverage receptacles, such as the stainless-steel vacuum receptacles are produced in a variety of sizes to accommodate for different beverage containers such as cans, beer bottles, water bottles, coffee cups, etc. However, these beverage receptacles cannot accommodate for minor variation in beverage container size, such as can size. As such, consumers are often forced to purchase multiple beverage receptacles to accommodate for minor variations in beverage containers to ensure they are able to use the beverage receptacle without rattling and instability.

To circumvent this issue, beverage receptacles have been created to store only the beverage, and not the beverage container. Unfortunately, these beverage receptacles require users to pour their beverage into the receptacle directly, creating additional unnecessary steps for the user and diluting the integrity of the beverage, in particular if the beverage is carbonated. Further, these receptacles must disadvantageously be washed after each use as otherwise there is contamination between beverages.

It would be advantageous if there were provided a beverage receptacle that could provide insulation as well as being non-slip, ergonomic and protecting a user's hands from the temperature of the beverage.

It is an object of the present invention to overcome or ameliorate at least one of the disadvantages of the prior art, or to provide a useful alternative.

SUMMARY OF INVENTION

In accordance with a first aspect of the present invention there is provided a beverage receptacle configured to receive a beverage container, comprising: a tubular body having a tubular portion and a base; a cavity within the tubular body adapted to receive the beverage container; a rubber sleeve at least partially surrounding the tubular portion of the tubular body; a bearing means adapted to bear on the beverage container; and wherein the beverage receptacle is formed of an insulating material.

In an embodiment, the base is removable.

In an embodiment, the base is threading received by the tubular portion.

In an embodiment, the bearing means is a flexible gasket locatable on a portion of an inner face of the cavity adjacent to an upper rim of the tubular body.

In an embodiment, in a closed position the base is received by a lower opening of the tubular portion, and in an open position the base is detached from tubular portion such that the beverage container is configured to be received by the lower opening into the cavity.

In an embodiment, the tubular portion is formed of stainless steel and the base is formed of plastic.

In an embodiment, the bearing means comprises: a ring; a pair of projection receiving channels running along the upper and lower portion of the ring configured to be received by a pair of projections on an inner face of the cavity adjacent to an upper rim of the tubular body; one or more strips perpendicular to the pair of projections; and wherein the one or more strips are adapted to bear of the beverage container.

In an embodiment, the one or more strips are coated with silicone.

In an embodiment, the bearing means is a threaded ring comprising: an upper end seated on an upper rim of the tubular body; a lower end comprising a threaded portion configured to be received by a complimentary threaded portion on an inner face of the cavity; one or more strips connected to the upper and lower end; and wherein upon rotation of the threaded portion along the complimentary threaded portion, the one or more strips are configured to bend.

In an embodiment, in an open position the one or more strips are parallel to the tubular portion, and in a closed position the one or more strips bend such that they bear on the beverage container.

In an embodiment, the bearing means comprises: a fixed first portion; a second portion connected to the first portion and adapted to be rotated; one or more strips connected to the first and second portion; and wherein upon rotation of the second portion, the one or more strips are configured to bend.

In an embodiment, in an open position the one or more strips are parallel to the tubular portion, and in a closed position the one or more strips bend such that they bear on the beverage container.

In an embodiment, the bearing means is locatable in the base and comprises: a fixed first portion; a second portion connected to the first portion and adapted to be rotated upon rotation of the base; one or more strips connected to the first and second portion; and wherein upon rotation of the base, the one or more strips are configured to bend.

In an embodiment, in an open position the one or more strips are parallel to the tubular portion, and in a closed position the one or more strips bend such that they bear on the beverage container.

In an embodiment, the bearing means is received by an upper rim portion of the cavity such that the bearing means bears on the beverage container.

In an embodiment, rotation of the beverage container in a first direction increases the force exerted by the bearing means and rotation in of the beverage container in the second direction decreases the force exerted by the bearing means.

In an embodiment, the rubber sleeve is formed of neoprene.

In an embodiment, the rubber sleeve is removable.

In an embodiment, the bearing means is removable.

In an embodiment, the thermally insulating material is stainless steel.

In an embodiment, the beverage receptacle is vacuum sealed.

In an embodiment, the beverage receptacle is twin walled and/or triple walled.

In accordance with another aspect of the present invention there is provided an insert for a beverage receptacle cavity including: an annular body having at least one member inter-lockable with an inner face of the receptacle cavity.

In an embodiment, the annular body further includes at least one sprung leg extending orthogonally from the annular body.

In an embodiment, the annular body further includes at least one first support and at least one second support, the at least one second support being located concentrically to the at least one first support so that when a container is inserted into the cavity and the container engages the at least one first support the annular body travels in the cavity until the annular body reaches a location proximal to the base, and when a container engages the at least one second support the at least one inter-lockable member interlocks with an inner face of the receptacle cavity.

Referring again to the first aspect of the invention, in an embodiment an inner face of the cavity further includes at least one recess for receiving at least one inter-lockable member of an insert for a beverage receptacle cavity.

In an embodiment, the at least one recess extends along the circumference of an inner face of the cavity.

Referring again to another aspect of the invention, the at least one inter-lockable member includes the at least one second support, and the at least one inter-lockable member is connected to the annular body by a resiliently flexible section.

In an embodiment, the at least one inter-lockable member is inter-lockable with a beverage receptacle.

BRIEF DESCRIPTION OF DRAWINGS

Preferred features, embodiments and variations of the invention may be discerned from the following detailed description which provides sufficient information for those skilled in the art to perform the invention. The detailed description is not to be regarded as limiting the scope of the preceding summary of the invention in any way.

Specific embodiments of the present invention are described, by way of example only, with reference to the accompanying drawings, in which.

DETAILED DESCRIPTION

Embodiments of the present disclosure described herein relate to a beverage receptacle formed of an insulating material configured to receive a beverage container, comprising a tubular body having a tubular portion and a base. A cavity is located within the tubular body and is adapted to receive the beverage container such that a bearing means bears on the beverage container. A rubber sleeve at least partially surrounds the tubular portion of the tubular body.

Figure 1:
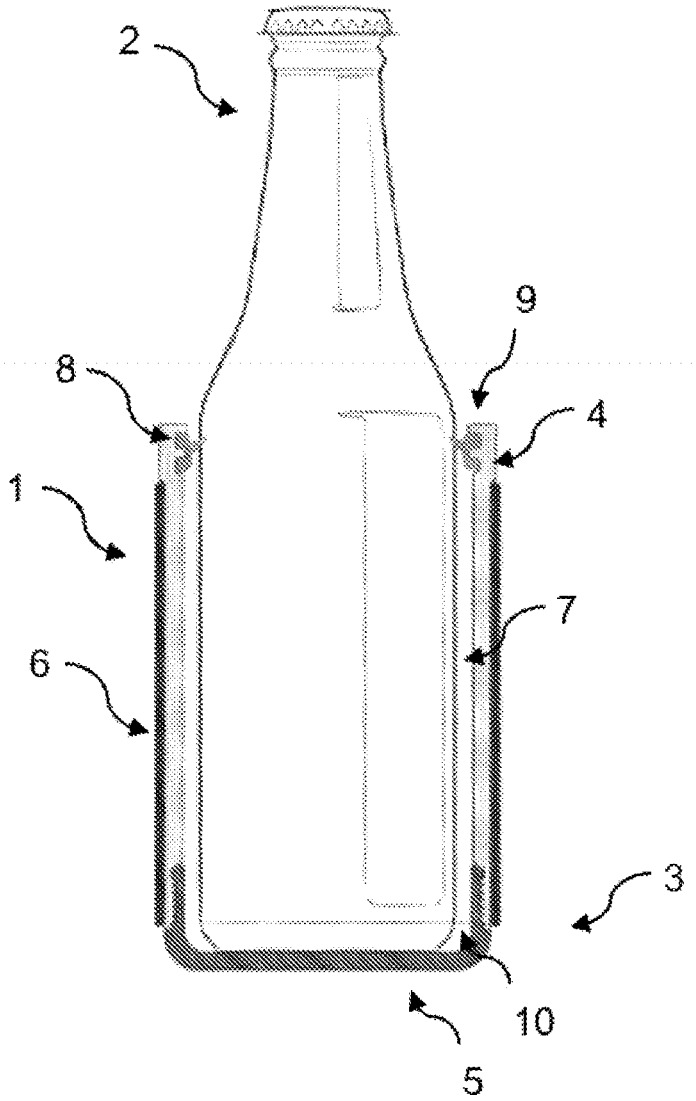
FIG. 1 is a cross-sectional front view of a beverage receptacle in accordance with an embodiment of the invention in a closed position.
Figure 2:
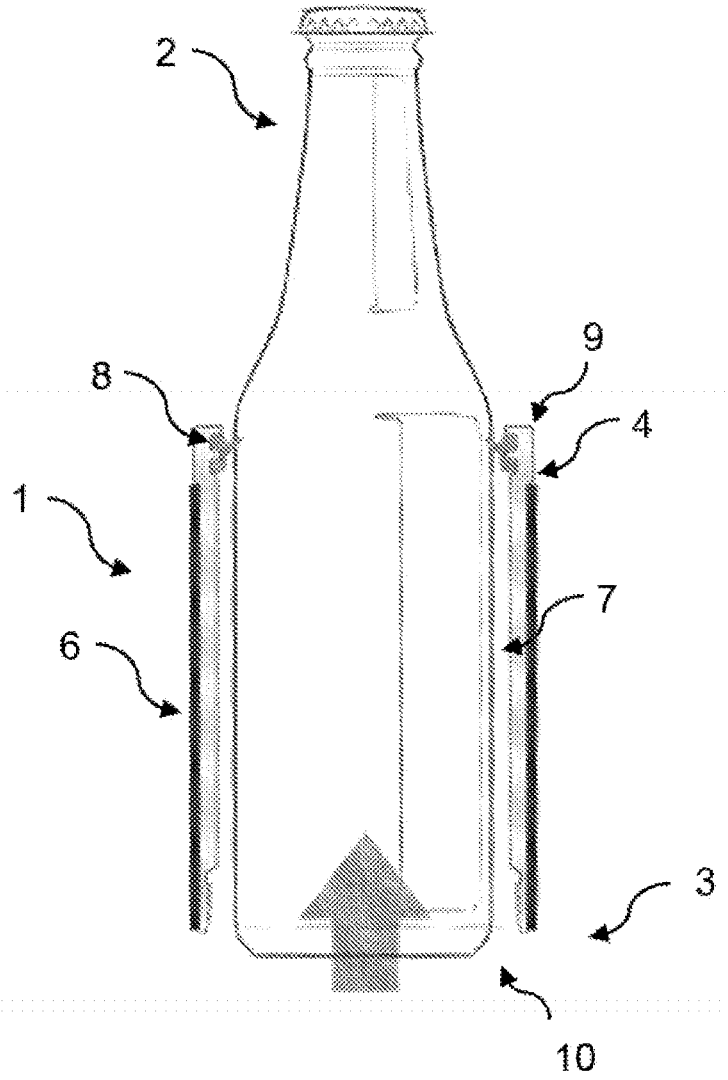
FIG. 2 is a cross-sectional front view of the beverage receptacle of FIG. 1 in an open position.

FIGS. 1 and 2 depict a cross-sectional front view of a beverage receptacle (1) in accordance with an embodiment of the invention, wherein the beverage receptacle (1) is configured to receive a beverage container (2). The beverage receptacle (1) comprises a tubular body (3) having a tubular portion (4) and a removable base portion (5). The removable base portion (5) is threadingly received by respective threads on the removable base portion (5) and the tubular portion (4).

A rubber sleeve (6) surrounds the tubular portion (4) of the tubular body (3). A cavity (7) is defined within the tubular body (3) and is adapted to receive the beverage container (2). A bearing means (8) in the form of a silicone or rubber gasket is received by a pair of channels running along the diameter of an inner face of the cavity (7) adjacent to an upper rim (9) of the tubular body (3). The bearing means (8) comprises an inwardly facing projection adapted to bear on the beverage container (2) such that the beverage container (2) is held in place within the beverage receptacle (1) and any rattling is reduced.

FIG. 1 depicts the beverage receptacle (1) in a closed position wherein the removable base portion (5) is threadingly received by a lower opening (10) of the tubular body (3). FIG. 2 depicts the beverage receptacle (1) in an open position wherein the removable base portion (5) has been removed allowing the beverage container (2) to be inserted into the beverage receptacle (1). In use, the beverage container (2) is inserted into the beverage receptacle (1) by way of the lower opening (10) into the cavity (7) when the beverage receptacle (1) is in the open position. Once the beverage container (2) has been inserted into the cavity (7) and bears on the bearing means (8), the removable base (5) is threadingly received by the lower opening (10) and the beverage receptacle (1) is in the closed position with the beverage container (2) secured within the beverage receptacle (1).

In an embodiment, the removable base (5) is formed of the same material as the tubular portion (4), or is formed of a different material to the tubular portion (4). For example, the removable base (5) may be formed of plastic while the tubular portion (5) may be formed of stainless steel.

In an embodiment the flexible gasket is removable and formed of a flexible material such as but not limited to silicone, rubber, etc. allowing for beverage containers (2) of multiple sizes to be retained within the beverage receptacle (1).

Figure 3:
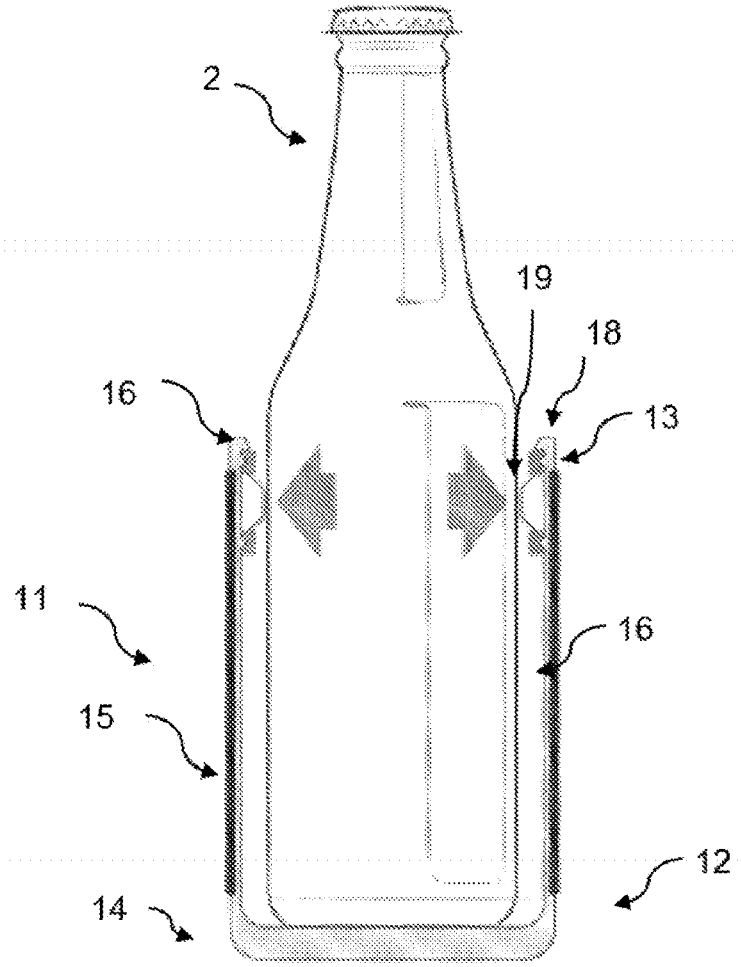
FIG. 3 is a cross-sectional front view of a beverage receptacle in accordance with an embodiment of the invention in a closed position.
Figure 4:
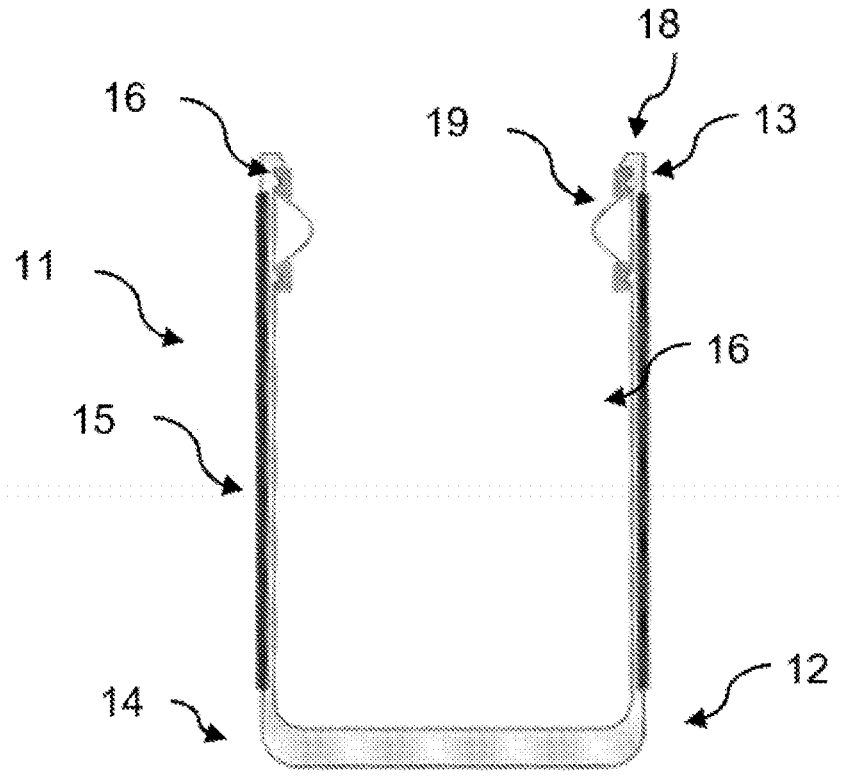
FIG. 4 is a cross-sectional front view of the beverage receptacle of FIG. 3 in an open position.

FIGS. 3 and 4 depict a cross-sectional front view of an alternate embodiment of the invention. FIG. 3 depicts an alternate beverage receptacle (11) configured to receive a beverage container (2). The beverage receptacle (11) comprising a tubular body (12) having a tubular portion (13) and a base (14). A rubber sleeve (15) surrounds the tubular portion (13) of the tubular body (12).

In an embodiment, the rubber sleeve (15) is removable.

A cavity (16) is defined within the tubular body (12) and is adapted to receive the beverage container (2). A bearing means (17) in the form of a ring with a pair of projection receiving channels facing outwardly is received by a pair of projections running along the diameter of an inner face of the cavity (16) adjacent to an upper rim (18) of the tubular body (12). The bearing means (17) further comprises one or more strips (19) located between the projection receiving channels for bearing on the beverage container (2). The one or more strips (19) are predominantly convex in shape such that the beverage container (2) is held in place within the beverage receptacle (11) and any rattling is reduced. A person skilled in the art would appreciate that the one or more strips (19) are convex in that they are raised from the inner wall of the cavity (16).

FIG. 3 depicts the beverage receptacle (11) in a closed position wherein the beverage container (2) has been received by the beverage receptacle (11). FIG. 4 depicts the beverage receptacle (11) in an open position wherein the beverage container (2) has not yet been received by the beverage receptacle (11). In the open position, the one or more strips (19) of the bearing means is convex in shape, such that the strips are raised from the inner wall of the cavity (16). In use in the closed position, the one or more strips (19) bear against the beverage container (2) to secure the beverage container (2) in the beverage receptacle (11). The one or more strips (19) are partially deformed such that they are no longer convex in shape and exert a force against the beverage container (2), however remain predominantly raised from the inner wall of the cavity. This allows for beverage containers (2) of multiple sizes to be retained within the beverage receptacle (11).

In an embodiment, the one or more strips (19) are formed of flexible plastic. In an alternate embodiment, the one or more strips (19) are formed of firm rubber. In a further embodiment, the one or more strips (19) are coated in silicone for increased grip. The one or more strips (19) may be evenly spaced along the ring, or may be unevenly spaced along the ring.

In an embodiment, the bearing means is comprised of only a single projection receiving channel.

Figure 5B:
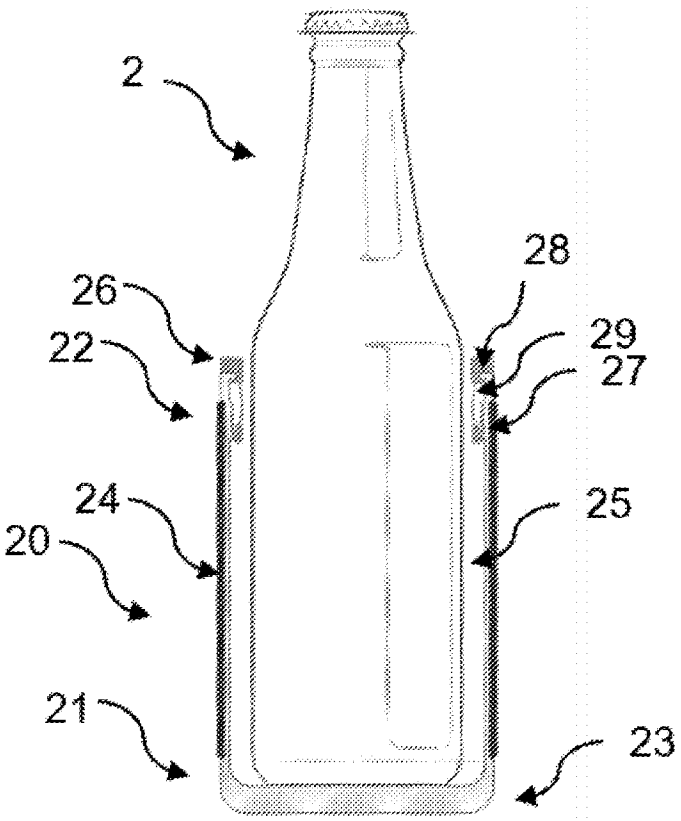
FIG. 5B is a cross-sectional front view of the beverage receptacle of FIG. 5A in an open position.
Figure 5A:
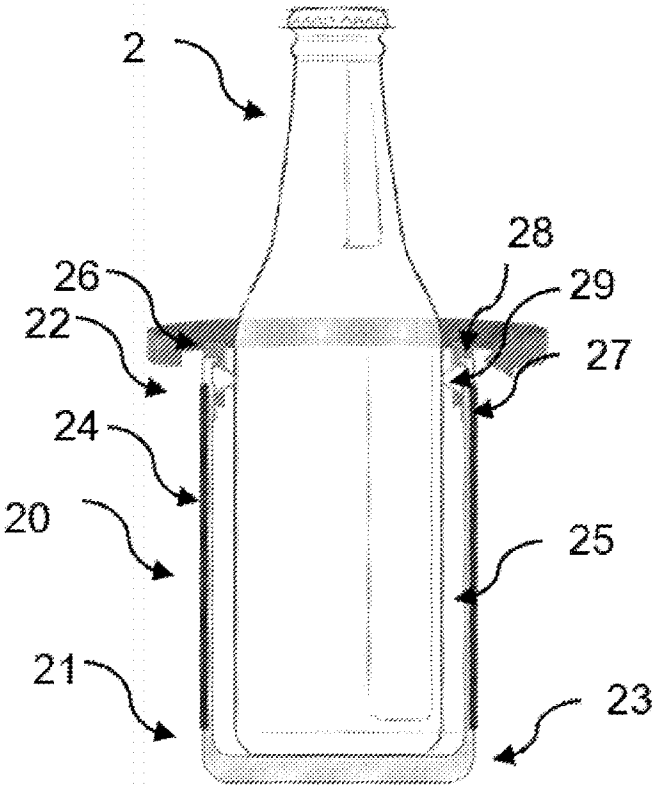
FIG. 5A is a cross-sectional front view of a beverage receptacle in accordance with an embodiment of the invention in a closed position.

FIGS. 5A and 5B depict a cross-sectional front view of an alternate embodiment of the beverage receptacle (20) configured to receive a beverage container (2). The beverage receptacle (20) comprising a tubular body (21) having a tubular portion (22) and a base (23). A rubber sleeve (24) surrounds the tubular portion (22) of the tubular body (21). A cavity (25) is defined within the tubular body (21) and is adapted to receive the beverage container (2).

A bearing means (26) in the form of a detachable ring is threadingly received by threads (27) located along the diameter of an inner face of the cavity (25) below an upper rim (28) of the tubular body (21). The threaded ring is comprised of a lower end and an upper end. The upper end is seated on the upper rim (28) of the tubular body (21) such that an upper rim projection is received within an upper rim projection channel of the threaded ring. The lower end of the threaded ring comprises threads which are complimentary to the threads (27) located along the diameter of an inner face of the cavity (25). One or more strips (29) are located between the upper and lower end of the threaded ring.

FIG. 5A depicts the beverage receptacle (20) in a closed position where the beverage container (2) has been received by the beverage receptacle (11). FIG. 5B depicts the beverage receptacle (20) in an open position wherein the beverage container (2) is able to be loaded and unloaded from the beverage receptacle (20). In the open position, the threaded ring is received by the threads (27) of the beverage receptacle (20) and the one or more strips (29) are extended such that they lay predominantly parallel to the tubular portion (22) allowing the beverage container (2) to be received within the cavity (25). In a closed position, the threaded ring has been rotated such that the lower end travels along the threads (27) towards the upper rim (28) of the beverage receptacle (20) and causes the one or more strips (29) to deform such that they bend and bear on the beverage container (2). In a closed position, the one or more strips (29) bear on the beverage container (2) such that the beverage container (2) remains in the beverage receptacle (20). To remove the beverage container (2), a user rotates the threaded ring such that the one or more strips (29) return to their predominantly parallel orientation allowing the beverage container (2) to be removed. This allows for beverage containers (2) of multiple sizes to be retained within the beverage receptacle (20).

Figure 6B:
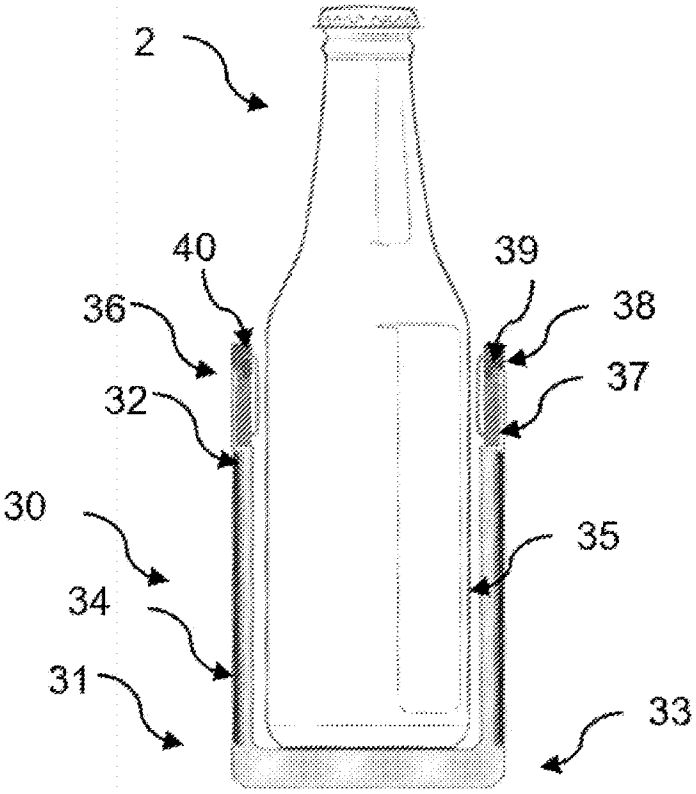
FIG. 6B is a cross-sectional front view of the beverage receptacle of FIG. 6A in an open position.
Figure 6A:
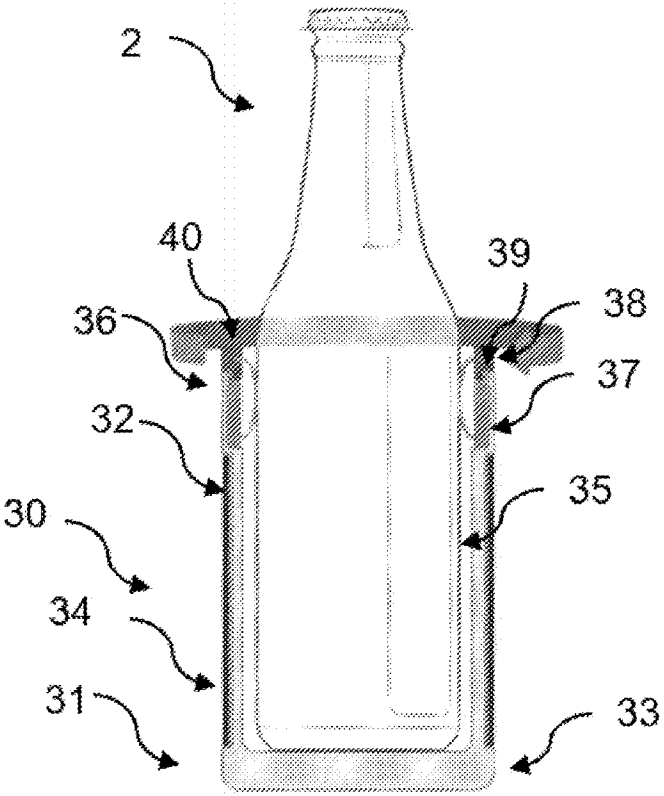
FIG. 6A is a cross-sectional front view of a beverage receptacle in accordance with an embodiment of the invention in a closed position.

FIGS. 6A and 6B depict a cross-sectional front view of an alternate embodiment of the beverage receptacle (30) configured to receive a beverage container (2). The beverage receptacle (30) comprising a tubular body (31) having a tubular portion (32) and a base (33). A rubber sleeve (34) surrounds the tubular portion (32) of the tubular body (31). A cavity (35) is defined within the tubular body (31) and is adapted to receive the beverage container (2). A bearing means (36) in the form of a coupled ring is adapted to bear on the beverage container (2). The coupled ring comprises a first portion (37) and second portion (38), wherein the first portion (37) is fixed to the tubular portion (32) while the second portion (38) is free to rotate. The inner face of the cavity (35) projects outwardly forming a stepped portion. The first portion (37) of the bearing means is seated on the stepped portion and extends along the stepped portion to the upper rim (39) of the tubular portion (32). The second portion (38) of the bearing means (36) is seated on the upper rim (39) of the tubular body (31), wherein a projection of the second portion (38) is seated on a stepped portion of the first portion (37). The coupled ring further comprises one or more strips (40) connected to the first and second portion (37, 38) and adapted to bear on the beverage container (2).

The one or more strips (40), in an embodiment, are formed of thin rubber, wherein opposing ends of the one or more strips (40) comprise a flange that is retained in the coupled ring. The first and second portion of the coupled ring (37, 38) sandwich the flanges. In an embodiment, the flanges comprise holes adapted to receive a post extending between and/or within the coupled rings to secure the orientation of each ring and better retain it.

FIG. 6A depicts the beverage receptacle (30) in a closed position where the beverage container (2) has been received by the beverage receptacle (30). FIG. 6B depicts the beverage receptacle (30) in an open position wherein the beverage container (2) is able to be loaded and unloaded from the beverage receptacle (30). In the open position, the one or more strips (40) are parallel to the tubular portion (32) allowing for the beverage container (2) to be loaded and unloaded from the beverage receptacle (30).

The first portion of the coupled rings (37) is free to rotate the second portion of the coupled rings (38) is fixed. To reach the closed position, the user rotates the first portion (37). In the closed position, the first portion of the coupled rings (37) tightens around the bottle such that they bear on the beverage container (2). This allows for beverage containers (2) of multiple sizes to be retained within the beverage receptacle (30).

In an embodiment, the coupled rings may have locking mechanisms to lock the beverage receptacle (30) into the closed position, wherein the locking mechanism can be unlocked. For example, the locking mechanism could be angled teeth that easily rotate in one direction, but require a great amount of force to be rotated in the opposing direction.

In an embodiment, the stepped portion further comprises a channel projection running along the diameter of an inner face of the cavity (35) stepped portion configured to receive a complimentary channel of the bearing means (36).

Figure 7B:
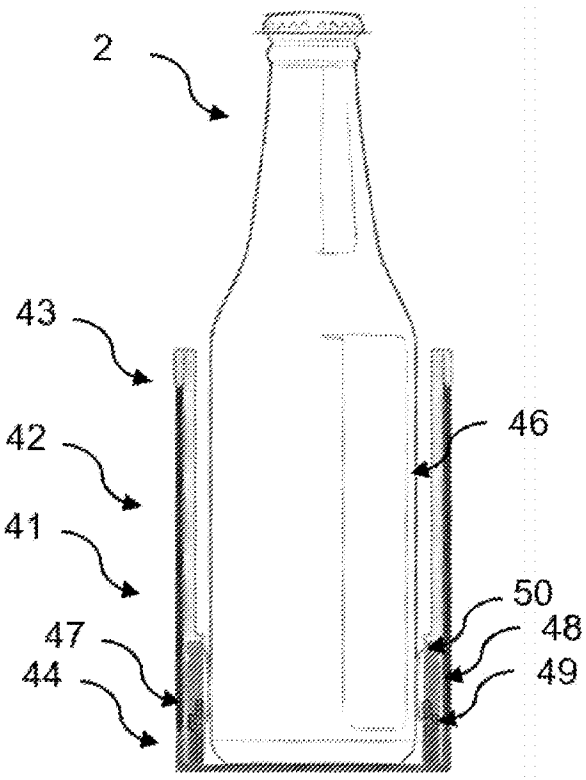
FIG. 7B is a cross-sectional front view of the beverage receptacle of FIG. 7A in an open position.
Figure 7A:
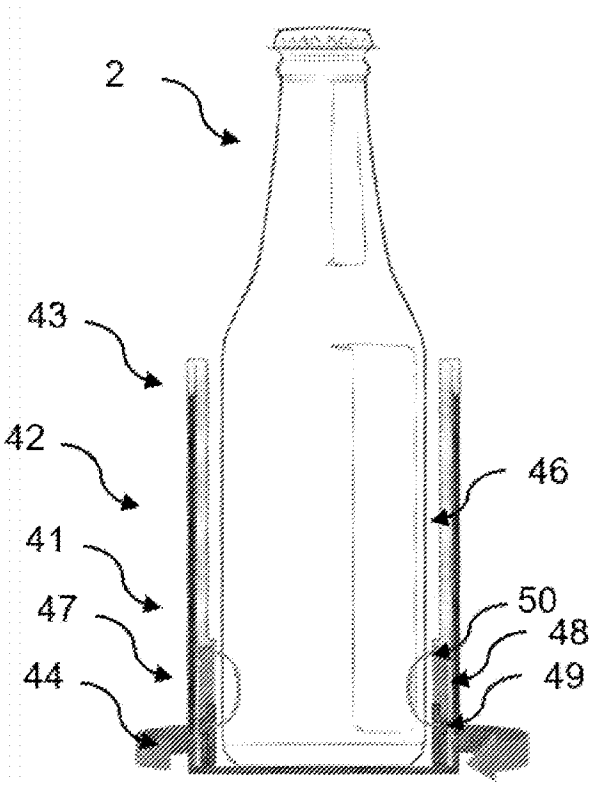
FIG. 7A is a cross-sectional front view of a beverage receptacle in accordance with an embodiment of the invention in a closed position.

FIGS. 7A and 7B depict a cross-sectional front view of an alternate embodiment of the beverage receptacle (41) configured to receive a beverage container (2). The beverage receptacle (41) comprising a tubular body (42) having a tubular portion (43) and a rotatable base (44). A rubber sleeve (45) surrounds the tubular portion (43) of the tubular body (42). A cavity (46) is defined within the tubular body (42) and is adapted to receive the beverage container (2). A bearing means (47) is located on the rotatable base (44) and is comprised of a first and second base portion (48, 49), wherein the first base portion (48) is fixed to the base (44) and the second base portion (49) is free to rotate. The bearing means (47) further comprises one or more strips (50) adapted to bear on the beverage container (2).

The one or more strips (50), in an embodiment, are formed of thin rubber, wherein opposing ends of the one or more strips (50) comprise a flange that is retained by the base (44). The first and second base portion (48, 49) sandwich the flanges. In an embodiment, the flanges comprise holes adapted to receive a post extending between and/or within the base portions (48, 49) to secure the orientation of each ring and better retain it.

FIG. 7A depicts the beverage receptacle (41) in a closed position where the beverage container (2) has been received by the beverage receptacle (41). FIG. 6B depicts the beverage receptacle (41) in an open position wherein the beverage container (2) is able to be loaded and unloaded from the beverage receptacle (41). In the open position, the one or more strips (50) are parallel to the tubular portion (43) allowing for the beverage container (2) to be loaded and unloaded from the beverage receptacle (41). In the closed position, the one or more strips (5) are bent such that they bear on the beverage container (2). To reach the closed position, the user rotates the base (44).

The second base portion (49) is free to rotate while the first base portion (48) is fixed. To reach the closed position, the user rotates second base portion (49). In the closed position, the second base portion (49) tightens around the bottle such that it bears on the beverage container (2). This allows for beverage containers (2) of multiple sizes to be retained within the beverage receptacle (30).

In an embodiment, the base portion may have a locking mechanism to lock the beverage receptacle (41) into the closed position, wherein the locking mechanism can be unlocked. For example, the locking mechanism could be angled teeth that easily rotate in one direction, but require a great amount of force to be rotated in the opposing direction.

Figure 8B:
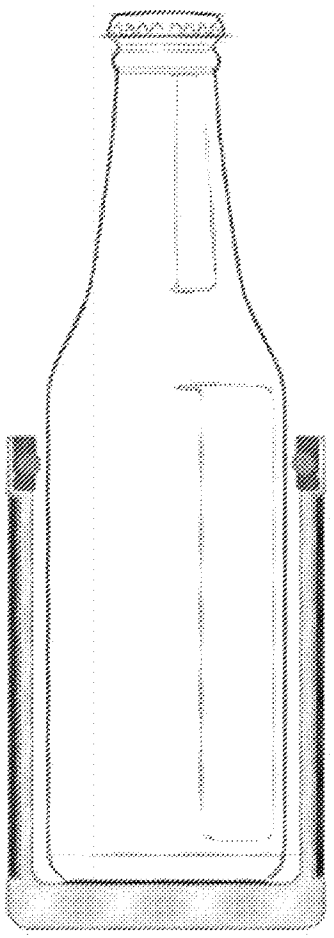
FIG. 8B is a cross-sectional front view of the beverage receptacle of FIG. 8A in an open position.
Figure 8A:
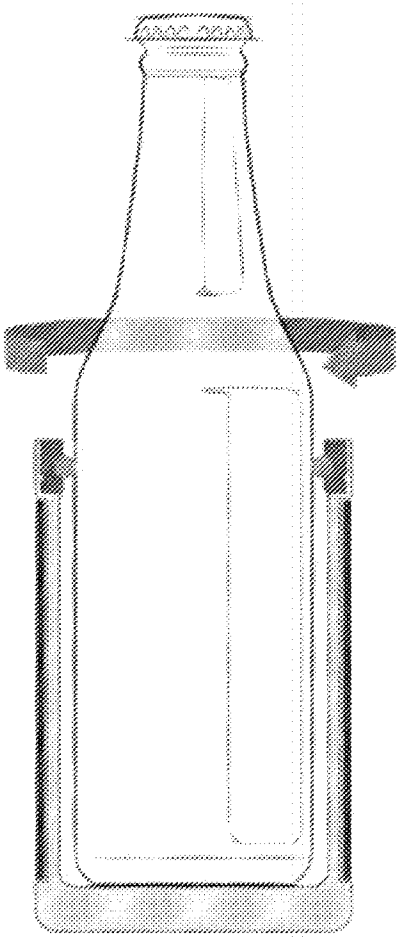
FIG. 8A is a cross-sectional front view of a beverage receptacle in accordance with an embodiment of the invention in a closed position.

FIGS. 8A and 8B depict a cross-sectional front view of an alternate embodiment of the beverage receptacle (51) configured to receive a beverage container (2). The beverage receptacle (51) comprising a tubular body (52) having a tubular portion (53) and a base (54). A rubber sleeve (55) surrounds the tubular portion (53) of the tubular body (52). A cavity (56) is defined within the tubular body (52) and is adapted to receive the beverage container (2). The inner channel face of the cavity (56) projects outwardly forming a stepped portion. The bearing means is seated on the stepped portion and extends along the stepped portion to align with the upper rim of the tubular portion (53).

FIG. 8A depicts the beverage receptacle (51) in a closed position where the beverage container (2) has been received by the beverage receptacle (51). FIG. 8B depicts the beverage receptacle (51) in an open position wherein the beverage container (2) is able to be loaded and unloaded from the beverage receptacle (51). To reach the closed position, the user rotates the beverage container (2).

Figure 9:
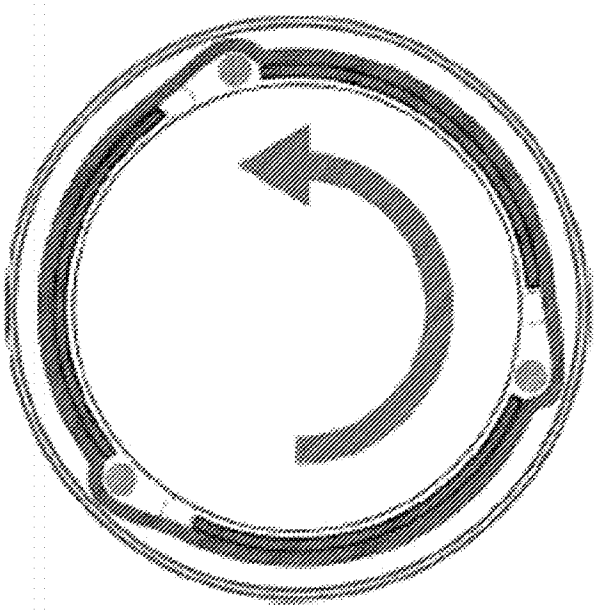
FIG. 9 is a cross-sectional top view of the beverage receptacle of FIG. 8A.

FIG. 9 is a cross-sectional top view of the bearing mechanism (57) of FIGS. 8A and 8B. A bearing mechanism (57), in the illustrated embodiment a rubber spherical object, is moved from a first position to a second position such that the beverage receptacle (51) moves from an open position to a closed position when the beverage container (2) is rotated. The rubber spherical object in on a rubber track. As the beverage container (2) is rotated, friction causes the rubber spherical objects to run on the track.

In an embodiment, the tracks are angled, allowing the rubber spherical objects to be wedged between the beverage container (2) and the track, clamping the beverage container (2) in place.

Figure 10:
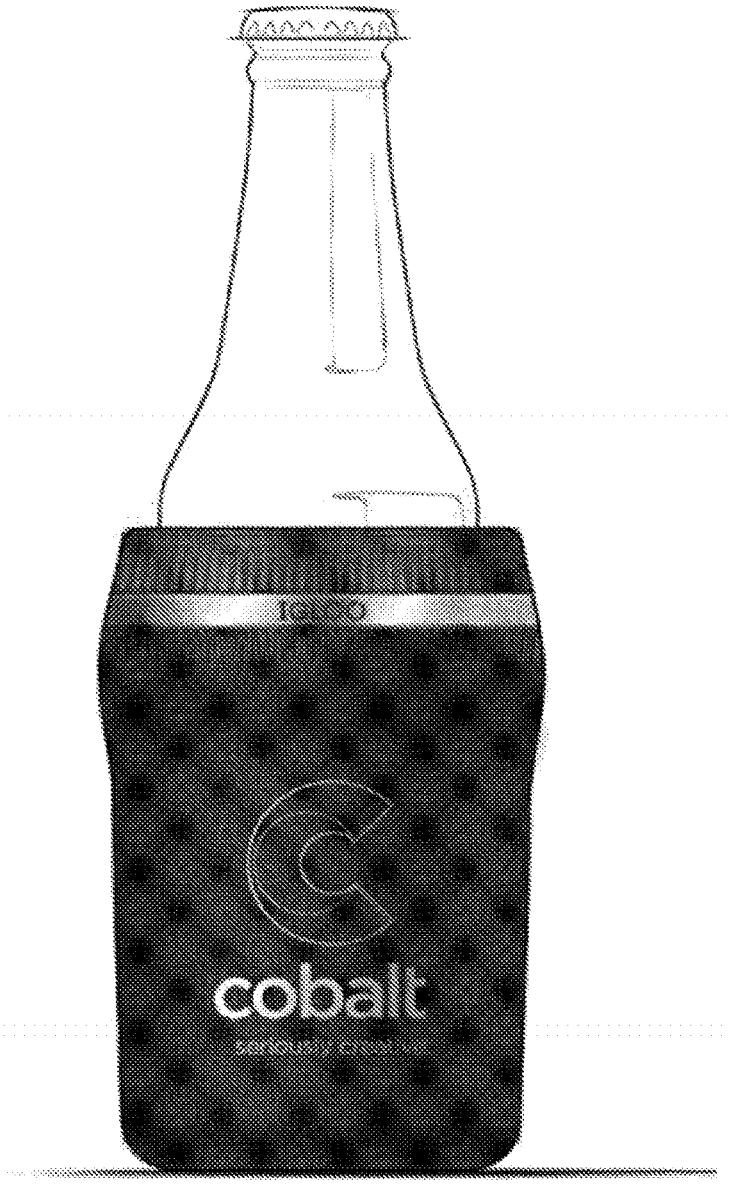
FIG. 10 is a front view of a beverage receptacle in accordance with an embodiment of the invention.
Figure 11:
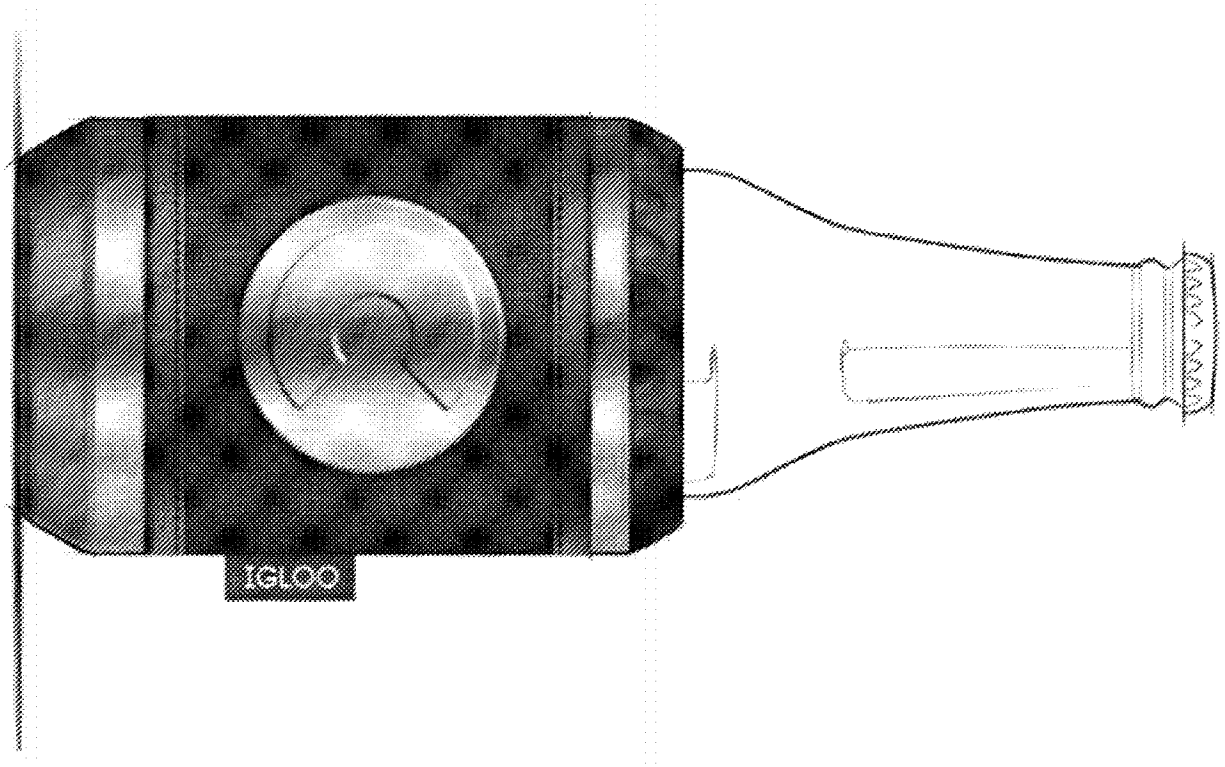
FIG. 11 is a front view of a beverage receptacle in accordance with an embodiment of the invention.
Figure 12:
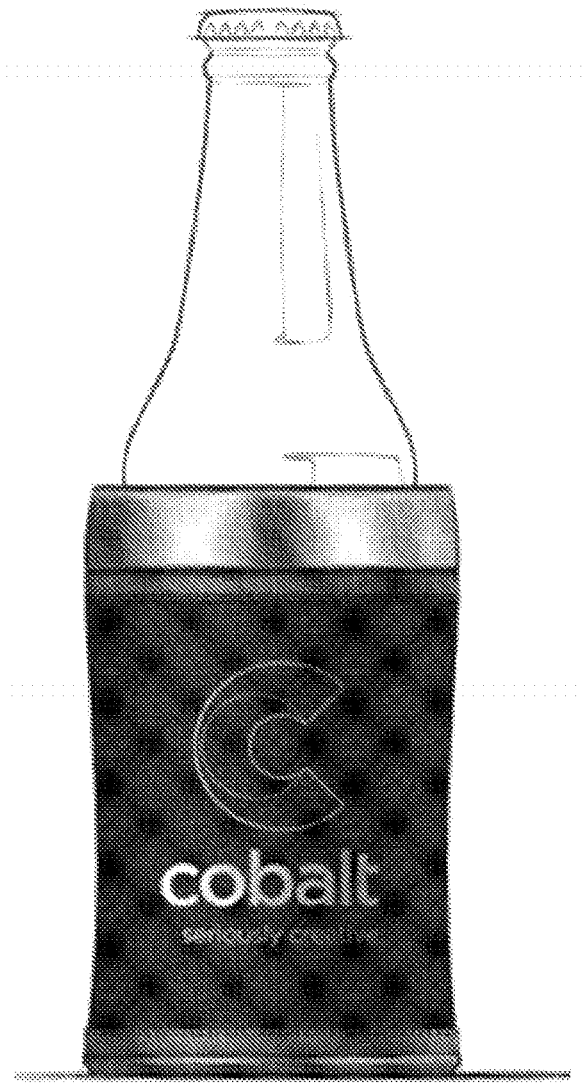
FIG. 12 is a front view of a beverage receptacle in accordance with an embodiment of the invention.

FIGS. 10 to 12 illustrate front views of embodiments of the invention in greater detail. In particular, the rubber sleeve is illustrated to surround the tubular portion such that a user is able to grip the rubber sleeve to hold the beverage receptacle. The rubber sleeve may encase the entirety of the tubular portion as well as the base as shown in the beverage receptacle (60) of FIG. 10, or may only cover portion of the tubular portion, as depicted in the beverage receptacles (61, 62) of FIGS. 11 and 12. In the embodiment of the invention depicted in FIG. 11, the rubber sleeve further comprises a circular cut-away portion which displays the logo on the beverage receptacle. In an alternate embodiment the logo may be printed on the rubber sleeve.

In an embodiment, a handle may be attached to the rims of the rubber sleeve for ease of holding the beverage receptacle.

In an embodiment, the beverage receptacle may further comprise a tool to open capped beverage containers such as capped bottles.

The beverage receptacle may be any colour, and may be formed of more than one colour. The beverage receptacle may prominently feature signs such as logos, branding, words etc. The signs may be embossed, engraved or painted on the beverage receptacle.

The shape of the beverage receptacle may be influenced by the shape of a beverage container. For example, a beverage container such as a pint glass or wheat glass is typically conical in shape, and therefore the beverage receptacle may also be conical in shape. An alternative beverage container is a can, and therefore the beverage receptacle may also be cylindrical in shape with tapered edges. The beverage receptacle may be any shape such that is does not depart from the invention, including but not limited to conical, tankard, rectangular, cylindrical, etc.

In an embodiment, the bearing means may be removable from the beverage receptacle.

In an embodiment the upper rim of beverage receptacle may be straight, chamfered or bevelled.

In an embodiment the one or more rims of the rubber sleeve are densely stitched. In an alternate embodiment one or more rim of the rubber sleeve may be binded or left untreated.

The rubber sleeve may sit proud of the beverage receptacle. In an alternate embodiment, the tubular portion comprises an indented portion wherein the rubber sleeve is received, such that the outer face of the rubber sleeve is flush with the outer face of the tubular portion.

The rubber sleeve may be formed of any rubber material that does not depart from the nature of the invention, including but not limited to neoprene, silicone, natural, nitrile, styrene-butadiene, butyl, polyurethane, etc.

The beverage receptacle in the embodiments is formed of thermally insulating materials, for example stainless steel, glass, plastic or any material that does not depart from the nature of the invention. The beverage receptacle may be formed of an insulating or conducting material such that the temperature of the beverage is maintained for a period of time.

The beverage container may be any container that is adapted to hold a beverage or the like. Including but not limited to bottles, cans, cups, drinking containers, glasses, etc.

The beverage receptacle may be either single-walled, dual-walled or triple-walled. In an embodiment where the beverage receptacle is dual-walled, the beverage receptacle is vacuumed sealed. In an embodiment where the beverage receptacle is triple-walled, the beverage receptacle is coated with a copper or aluminium coating on the outer surface of the inner wall.

Figure 13:
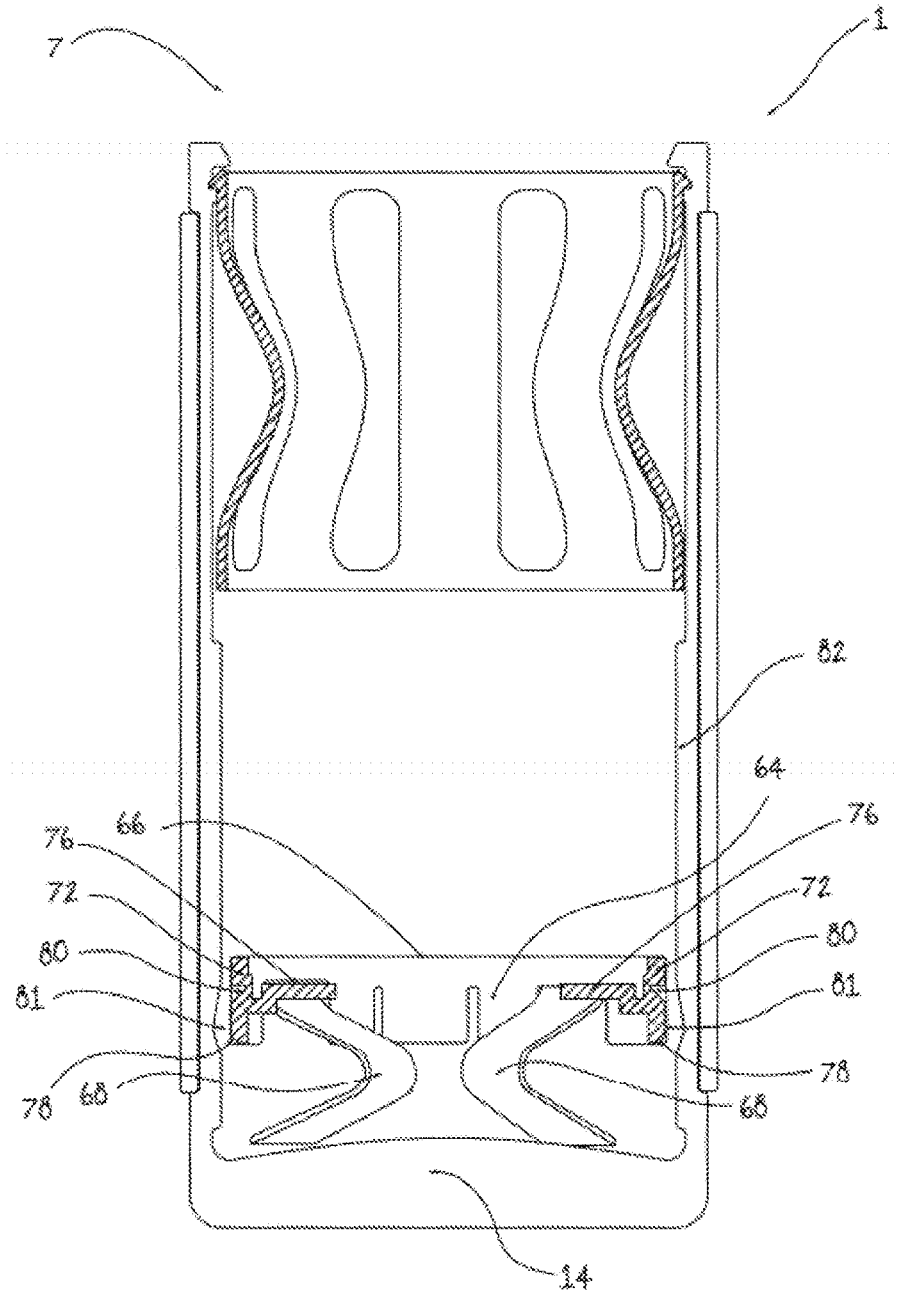
FIG. 13 is a front cross-section view of a beverage receptacle with an insert for a beverage receptacle in the cavity of the beverage receptacle in accordance with an embodiment of the invention.
Figure 16A:
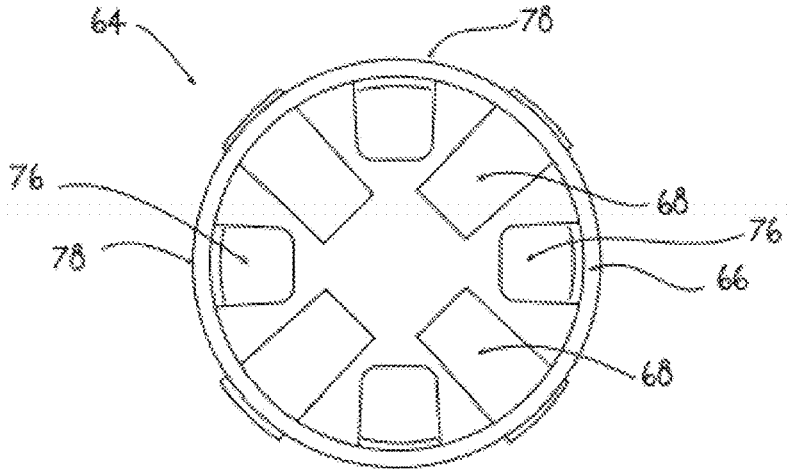
FIG. 16A is a top view of an insert for a beverage receptacle according to an embodiment of the invention.
Figure 16B:
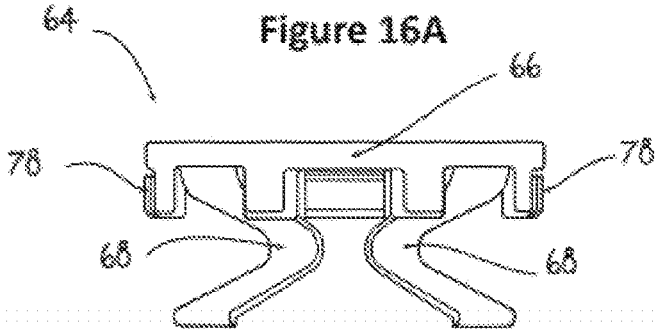
FIG. 16B is a front view of an insert for a beverage receptacle according to an embodiment of the invention.
Figure 16C:
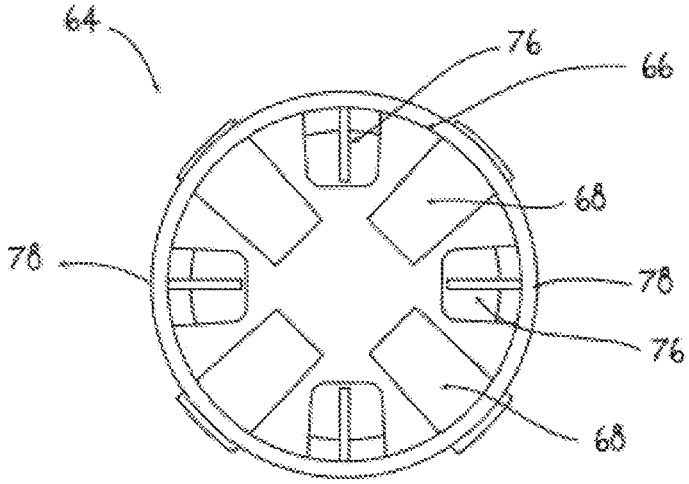
FIG. 16C is a bottom view of an insert for a beverage receptacle according to an embodiment of the invention.

In a preferred embodiment, an insert (64) for a beverage receptacle (1) cavity (7) can be used with the beverage receptacle (1). FIG. 13 depicts an insert (64) for a beverage receptacle (1) located in the cavity (7) of a beverage receptacle (1) shown in a cross-sectional front view. The annular body (66) of the insert (64) is supported on the base (14) by sprung legs (68) extending orthogonally from the annular body (66) of the insert (64). The insert (64) for a beverage receptacle (1) is depicted from the top in FIG. 16A, the front in FIG. 16B, and the bottom in FIG. 16C.

Figure 14:
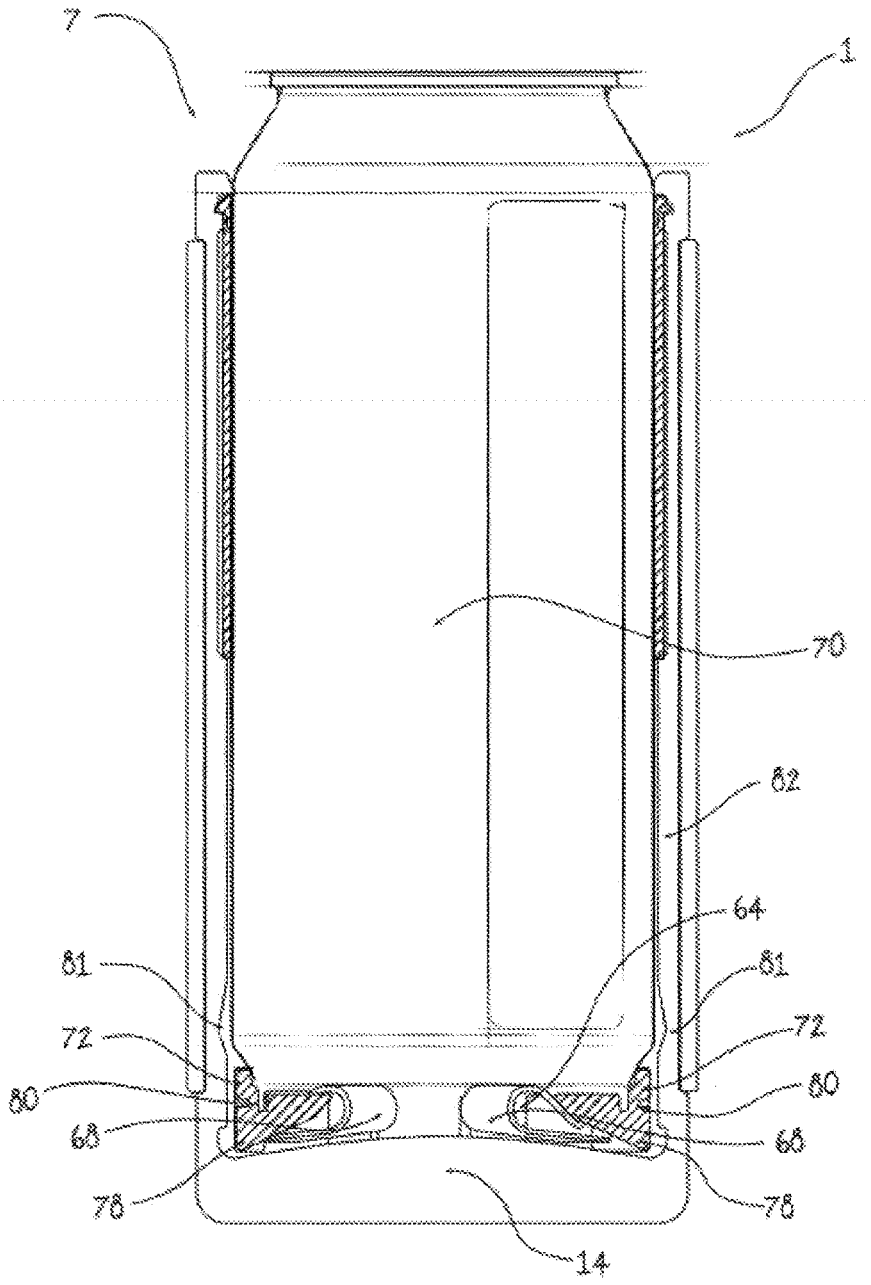
FIG. 14 is a front cross-section view of a beverage receptacle with a beverage container inserted into the cavity of the beverage receptacle and the beverage container is supported by an insert for a beverage receptacle according to an embodiment of the invention.
Figure 18:
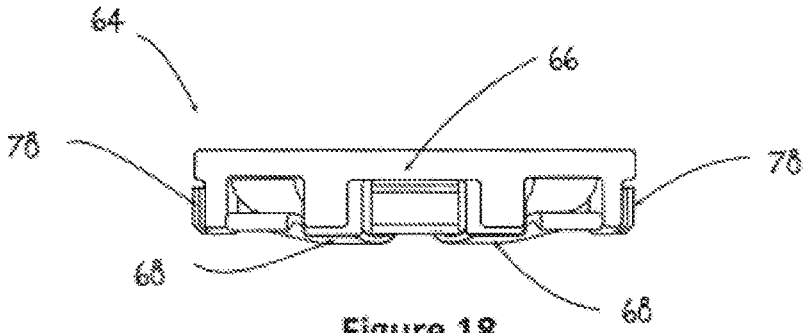
FIG. 18 is a front view of an insert for a beverage receptacle with the sprung legs compressed according an embodiment of the invention.

FIG. 14 depicts a cross-sectional front view of a beverage receptacle (1) with a broad and tall beverage container (70) having been inserted into the cavity (7) of the beverage receptacle (1) and being supported by the insert (64). The broad and tall beverage container (70) is vertically supported in the cavity (7) by an array of first supports (72) of the annular body (66). The sprung legs (68) are compressed under the weight of the broad and tall beverage container (70), and the annular body (66) has travelled axially in the cavity (7) to reach a location proximal to the base (14) and where it is thereby supported. The insert (64) for a beverage receptacle (1) with compressed sprung legs (68) is also depicted in FIG. 18. In use, as the broad and tall beverage container (70) is inserted in to the cavity (7) of the beverage receptacle (1) and as it engages the array of first supports (72) of the annular body (66), the sprung legs (68) become compressed under the weight of the broad and tall beverage container (70) and it and the annular body (66) travel axially in the cavity (7) of the beverage receptacle (1) until the annular body (66) reaches the base (14) and whereby the base (14) supports the annular body (66) and the broad and tall container (70) by means of the array of first supports (72) of the annular body (66).

Figure 15:
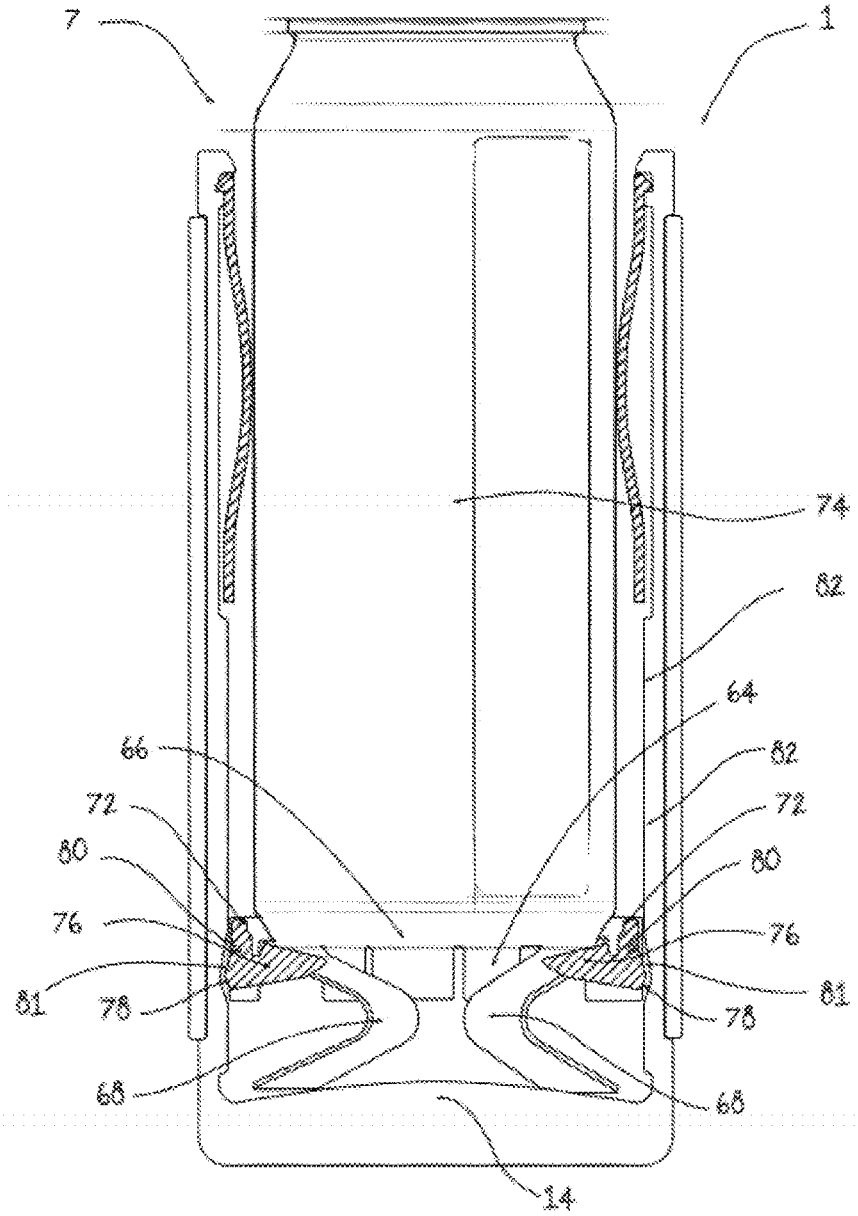
FIG. 15 is a front cross-section view of a beverage receptacle with a beverage container inserted into the cavity of the beverage receptacle and the beverage container is supported by an insert for a beverage receptacle according to an embodiment of the invention.
Figure 17:
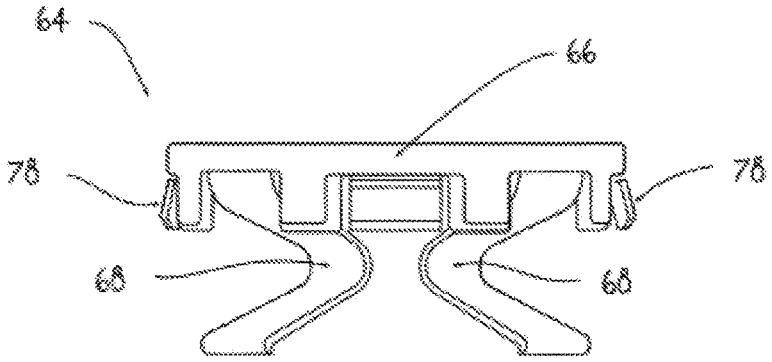
FIG. 17 is a front view of an insert for a beverage receptacle with inter-lockable members in an inter-locked position according to an embodiment of the invention.

FIG. 15 depicts a cross-sectional front view of a beverage receptacle (1) with a short and narrow beverage container (74) having been inserted into the cavity (7) of the beverage receptacle (1). The short and narrow beverage container (74) is supported by an array of second supports (76) which are part of inter-lockable members (78), each inter-lockable member (78) being connected to the annular body (64) by a resiliently flexible section (80). The inter-lockable members (78) are shown interlocked with a recess (81) in the form of a recess extending the circumference of the inner face (82) of the cavity (7) to thus vertically support the weight of the short and narrow beverage container (74). The sprung legs (68) remain uncompressed and the annular body (64) remains at a location in the cavity (7) such as that depicted in FIG. 13 wherein the beverage receptacle (1) is depicted without a beverage container having been inserted into the cavity of the beverage receptacle (1). FIG. 17 also depicts the insert (64) for a beverage receptacle (1) with the inter-lockable members (78) in an interlocking state. In use, as the short and narrow beverage container (74) is inserted into the cavity (7) of the beverage receptacle (1), and the short and narrow beverage container (74) engages the array of second supports (76) of the inter-lockable members (78), the inter-lockable members (76) pivot at the point of the corresponding resiliently flexible sections (80) to cause the inter-lockable members to swing outwardly and inter-lock with the recess (81) of the inner face (82) of the cavity (7) to thus support the short and narrow beverage container from further axial travel into the cavity (7).

The insert fora beverage container can be made from plastics, metal, or another suitable material or a combination of materials.

It will be appreciated that the insert for a beverage container can include any suitable number of sprung legs, inter-lockable members, first and/or second supports.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

The preceding description is provided in relation to several embodiments which may share common characteristics and features. It is to be understood that one or more features of any one embodiment may be combinable with one or more features of the other embodiments. In addition, any single feature or combination of features in any of the embodiments may constitute additional embodiments.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, the inventions have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments.

Further, each independent feature or component of any given assembly may constitute an additional embodiment.

The invention claimed is:

1. A beverage receptacle configured to receive a beverage container, comprising:
- a tubular body having a tubular portion and a base;
- a cavity within the tubular body adapted to receive the beverage container;
- a rubber sleeve at least partially surrounding the tubular portion of the tubular body;
- a bearer adapted to bear on the beverage container, the bearer comprising:
  - a ring,
  - a pair of projection receiving channels running along the upper and lower portion of the ring configured to be received by a pair of projections on an inner face of the cavity adjacent to an upper rim of the tubular body, and
  - one or more strips perpendicular to the pair of projections, the one or more strips being adapted to bear the beverage container;
- wherein the beverage receptacle is formed of an insulating material.

2. The beverage receptacle of claim 1, wherein the base is removable.

3. The beverage receptacle according to claim 2, wherein the base is threading received by the tubular portion.

4. The beverage receptacle of claim 3, wherein the bearer is a flexible gasket locatable on a portion of an inner face of the cavity adjacent to an upper rim of the tubular body.

5. The beverage receptacle according to claim 4, wherein in a closed position the base is received by a lower opening of the tubular portion, and in an open position the base is detached from the tubular portion such that the beverage container is configured to be received by the lower opening into the cavity, wherein the tubular portion is formed of stainless steel and the base is formed of plastic.

6. The beverage receptacle according to claim 1, wherein the one or more strips are coated with silicone.

7. The beverage receptacle of claim 1, wherein the bearer is received by an upper rim portion of the cavity such that the bearer bears on the beverage container.

8. The beverage receptacle of claim 7, wherein rotation of the beverage container in a first direction increases the force exerted by the bearer, and wherein rotation of the beverage container in the second direction decreases the force exerted by the bearer.

9. The beverage receptacle according to claim 8, wherein the rubber sleeve is formed of neoprene, wherein the rubber sleeve is removable, wherein the bearing is removable, wherein the thermally insulating material is stainless steel, wherein the beverage receptacle is vacuum sealed, and wherein the beverage receptacle is twin walled and/or tripled walled.

10. A beverage receptacle configured to receive a beverage container, comprising:
- a tubular body having a tubular portion and a base;
- a cavity within the tubular body adapted to receive the beverage container;
- a rubber sleeve at least partially surrounding the tubular portion of the tubular body;
- a bearer adapted to bear on the beverage container,
- wherein the bearer is a threaded ring comprising:
  - an upper end seated on an upper rim of the tubular body;
  - a lower end comprising a threaded portion configured to be received by a complimentary threaded portion on an inner face of the cavity; and
  - one or more strips connected to the upper and lower end;
- wherein upon rotation of the threaded portion along the complimentary threaded portion, the one or more strips are configured to bend; and
- wherein the beverage receptacle is formed of an insulating material.

11. The beverage receptacle of claim 10, wherein in an open position, the one or more strips are parallel to the tubular portion, and wherein in a closed position, the one or more strips bend such that the one or more strips bear on the beverage container.

12. A beverage receptacle configured to receive a beverage container, comprising:
- a tubular body having a tubular portion and a base;
- a cavity within the tubular body adapted to receive the beverage container;
- a rubber sleeve at least partially surrounding the tubular portion of the tubular body;
- a bearer adapted to bear on the beverage container,
- wherein the bearer comprises:
  - a fixed first portion;
  - a second portion connected to the first portion and adapted to be rotated; and one or more strips connected to the first and second portions;

wherein upon rotation of the second portion, the one or more strips are configured to bend; and wherein the beverage receptacle is formed of an insulating material.

13. The beverage receptacle of claim 12, wherein in an open position, the one or more strips are parallel to the tubular portion, and wherein in a closed position, the one or more strips bend such that the one or more strips bear on the beverage container.

14. A beverage receptacle configured to receive a beverage container, comprising:

a tubular body having a tubular portion and a base;

a cavity within the tubular body adapted to receive the beverage container;

a rubber sleeve at least partially surrounding the tubular portion of the tubular body;

a bearer adapted to bear on the beverage container, wherein the bearer is locatable in the base and comprises:

a fixed first portion;

a second portion connected to the first portion and adapted to be rotated upon rotation of the base; and one or more strips connected to the first and second portions;

wherein upon rotation of the base, the one or more strips are configured to bend; and wherein the beverage receptacle is formed of an insulating material.

15. The beverage receptacle of claim 14, wherein in an open position, the one or more strips are parallel to the tubular portion, and wherein in a closed position, the one or more strips bend such that the one or more strips bear on the beverage container.

16. A beverage receptacle configured to receive a beverage container, comprising:

a tubular body having a tubular portion and a base;

a cavity within the tubular body adapted to receive the beverage container;

a rubber sleeve at least partially surrounding the tubular portion of the tubular body;

a bearer adapted to bear on the beverage container, wherein an inner face of the cavity further comprises at least one recess for receiving at least one inter-lockable member of an insert for a beverage receptacle cavity, wherein the insert for the beverage receptacle cavity comprises an annular body having the at least one inter-lockable member for engaging with the inner face of the beverage receptacle cavity, wherein the annular body further comprises:

at least one sprung leg extending orthogonally from the annular body, at least one first support for a container, and at least one second support, the at least one second support being located concentrically to the at least one first support so that when a container is inserted into the cavity and the container engages the at least one first support, the annular body travels in the cavity until the annular body reaches a location proximal to the base, and when a container engages the at least one second support, the at least one inter-lockable member interlocks with the inner face of the beverage receptacle cavity, and wherein the beverage receptacle is formed of an insulating material.

17. The beverage receptacle according to claim 16, wherein the at least one recess extends along the circumference of the inner face of the cavity.

18. The beverage receptacle according to claim 16, wherein the at least one inter-lockable member comprises the at least one second support, and the at least one inter-lockable member is connected to the annular body by a resiliently flexible section.

19. The beverage receptacle according to claim 18, wherein the at least one inter-lockable member is inter-lockable with the beverage receptacle.

* * * * *